US005545840A

United States Patent [19]

Doi et al.

[11] Patent Number: 5,545,840

[45] Date of Patent: Aug. 13, 1996

[54] DEVELOPING DEVICE IN ELECTROPHOTOGRAPHIC APPARATUS INCLUDING DEVELOPING POLL CONFIGURATION WHILE STABLY CARRIES DEVELOPER

[75] Inventors: Koji Doi; Yasuyuki Tsuji; Shuuho Yokokawa; Kunitomo Takahashi; Youji Hirose; Hiroshi Ueno; Youichi Takeuchi; Koutara Yamada; Hidenori Iwanaga, all of Ibaraki, Japan

[73] Assignee: Hitachi Koki Co., Ltd., Tokyo, Japan

[21] Appl. No.: 489,277

[22] Filed: Jun. 9, 1995

[30] Foreign Application Priority Data

Jun. 17, 1994 [JP] Japan ..... 6-135868

[51] Int. Cl.[6] ..... G03G 15/09

[52] U.S. Cl. ..... 118/658; 355/251

[58] Field of Search ..... 355/251, 253; 118/658

[56] References Cited

U.S. PATENT DOCUMENTS 4,177,757 12/1979 Murakawa et al. ..... 118/658
4,436,055 3/1984 Yamashita et al. ..... 118/658

FOREIGN PATENT DOCUMENTS 60-115972 6/1985 Japan .
1-319070 12/1989 Japan .

*Primary Examiner*—Joan H. Pendegrass
*Assistant Examiner*—Sophia S. Chen
*Attorney, Agent, or Firm*—Sughrue, Mion, Zinn, Macpeak & Seas

[57] ABSTRACT

A developing device in an electrophotographic apparatus, wherein a pole $c_1$ which is a delivering magnetic pole of the second developing roll for delivering the developer to the first developing roll and a pole $d_1$ which is a receiving magnetic pole of the second developing roll for receiving the developer from the first developing roll are set so as to be the same in polarity, whereas a pole $a_2$ which is a receiving magnetic pole of the first developing roll for receiving the developer from the second developing roll and a pole $g_2$ which is a delivering magnetic pole of the first developing roll for delivering the developer to the second developing roll are set to be equal in polarity, wherein each of an angle between the poles $c_1$ and $d_1$ and an angle between the poles $a_2$ and $g_2$ is set so as to be in a range of from 70° to 120°, and wherein the magnetic flux density of each of a reaction pole induced between the poles $c_1$ and $d_1$ and a reaction pole induced between the poles $a_2$ and $g_2$ is set so as to be less than or equal to 0.015 tesla.

2 Claims, 1 Drawing Sheet

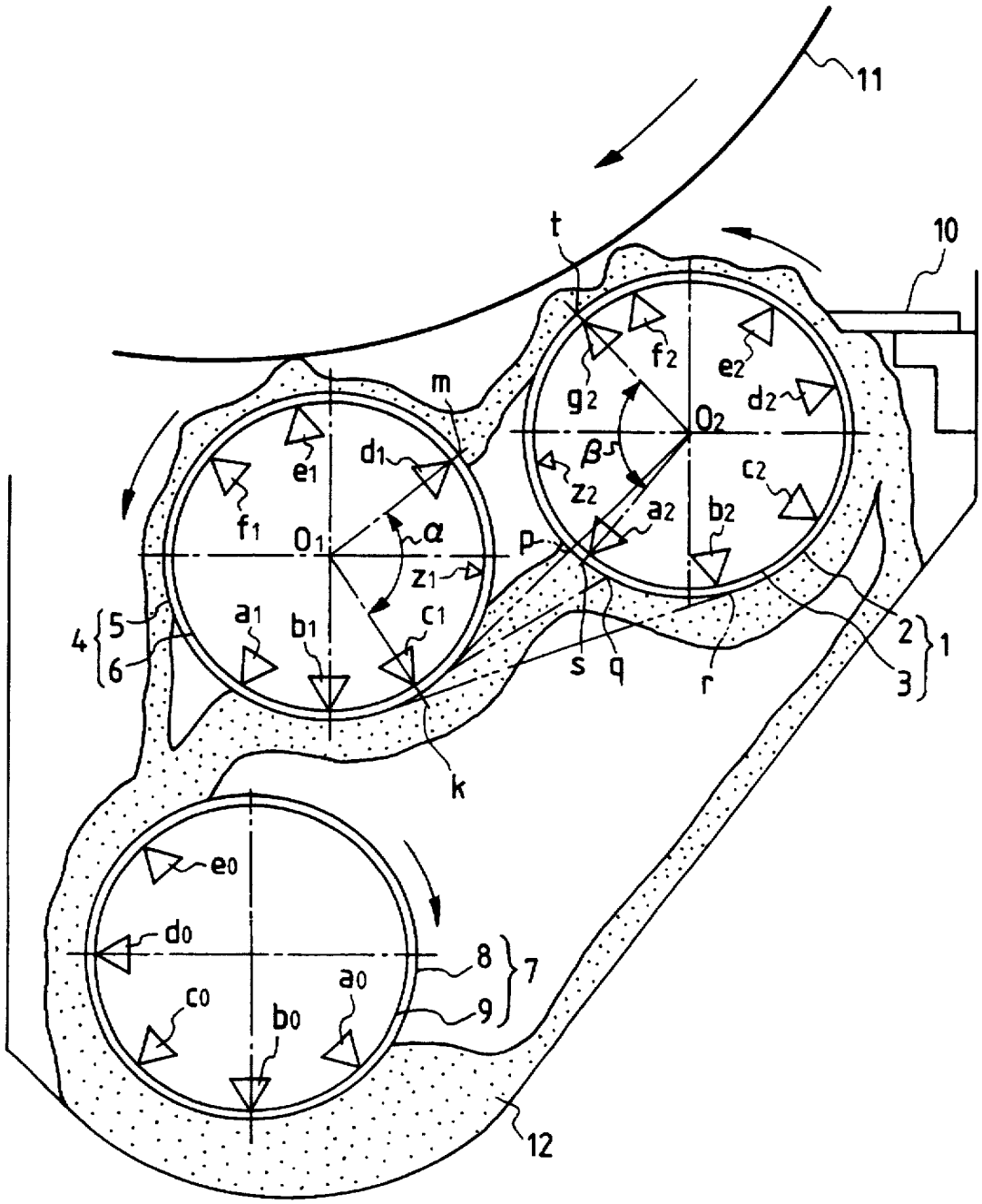
11
10
t
m
f2
e2
g2
d2
O2
β
c2
z2
a2
b2
e1
d1
f1
O1
α
p
z1
a1
b1
c1
5
4
6
s
q
r
2
1
3
k
e0
d0
8
7
9
a0
c0
b0
12

DEVELOPING DEVICE IN ELECTROPHOTOGRAPHIC APPARATUS INCLUDING DEVELOPING POLL CONFIGURATION WHILE STABLY CARRIES DEVELOPER

BACKGROUND OF THE INVENTION

1. Field of the Invention

The present invention relates to a developing device in an electrophotographic apparatus and particularly relates to an improvement in a developing device of the type having first and second developing rolls which rotate in the same direction.

2. Description of the Related Art

The developing device of this type in an electrophotographic apparatus, having first and second developing rolls rotating in the same direction, is known, for example, from U.S. Pat. No. 4,177,757, etc.

In the developing device of this type, if the rotational speed of the developing rolls is increased to improve the printing speed, a centrifugal force given to a developer on the surface of the developing rolls is increased so that the force by which the developer on the delivering magnetic pole of the second developing roll is thrown out in the direction of a tangential line drawn from the position of the delivering magnetic pole to the side of the direction of rotation of the developing roll is increased. Accordingly, the magnetic field acting between the delivering magnetic pole of the second developing roll and the receiving magnetic pole of the first developing roll is not sufficient to deliver the developer from the second developing roll to the first developing roll. Accordingly, a part of the developer is involved in the direction of the rotation of the first developing roll. There arises a problem in that the developer is jammed not only between the second developing roll and the first developing roll but also between the second developing roll and a photosensitive body so that it becomes impossible to obtain a stable printing quantity or it becomes impossible to rotate the photosensitive body or the developing rolls so that printing cannot be carried out.

SUMMARY OF THE INVENTION

An object of the present invention is to provide an improved developing device in an electrophotographic apparatus, in which even in the case where the rotational speed of developing rolls is increased to improve the printing speed, that is, even in the case where a developer is thrown out by a centrifugal force produced by the rotation of the developing rolls, stable delivery of the developer between the first developing roll and the second developing roll is performed, and the developer is prevented from being jammed between two adjacent developing rolls and between a developing roll and a photosensitive body unlike in the conventional case. Thus, stable printing quality can be obtained. Further, it is possible to solve such a problem that the rotation of the photosensitive body or the developing roll becomes impossible to make the carrying out of the printing impossible.

The foregoing object has been achieved by performing setting so that a magnetic pole ($c_1$) which is a delivering magnetic pole of a second developing roll for delivering a developer to a first developing roll and a magnetic pole ($d_1$) which is a receiving magnetic pole of the second developing roll for receiving the developer from the first developing roll are set so as to be the same in polarity with each other, the angle between the delivering and receiving magnetic poles ($c_1$ and $d_1$) of the second developing roll is set so as to be in a range of from 70° to 120°, and the magnetic flux density of a reaction pole induced between the delivering and receiving magnetic poles ($c_1$ and $d_1$) of the second developing roll is set so as to be not higher than 0.015 tesla (hereinafter abbreviated to T), and by performing setting so that a magnetic pole ($a_2$) which is a receiving magnetic pole of the first developing roll for receiving the developer from the second developing roll and a pole ($g_2$) which is a delivering magnetic pole of the first developing roll for delivering the developer to the second developing roll are set so as to be the same in polarity with each other, the angle between the receiving and delivering magnetic poles ($a_2$ and $g_2$) of the first developing roll is set so as to be in a range of from 70° to 120°, and the magnetic flux density of a reaction pole induced between the receiving and delivering magnetic poles ($a_2$ and $g_2$) of the first developing roll is set so as to be not higher than 0.015 T.

According to the aforementioned configuration, in the case where the rotational speed of the developing rolls is increased to improve the printing speed, not only the magnetic field of the developer-receiving magnetic pole acting on the developer thrown out from the developer-delivering magnetic pole of the first developing roll is weak because the angle between the developer-delivering magnetic pole and the developer-receiving magnetic pole on the developing roll is set so as to be in a range of from 70° to 120°, preferably, from 90° to 100° which is larger than the conventional value (about 45°), but also the magnetic field of the reaction pole acting on the developer thrown out from the developing roll is weak because the reaction pole induced between the developer-delivering magnetic pole and the developer-receiving magnetic pole is set to be 0.015 T, preferably, 0.01 T, which is a small value. As a result, the developer thrown out from the developer-delivering magnetic pole is not involved in the developer-receiving magnetic pole side of the developing roll but it is carried to the developer-receiving magnetic pole of an adjacent developing roll stably.

Incidentally, the above limitation of numerical values is based on experimental results. As for the angle between the developer-delivering magnetic pole and the developer-receiving magnetic pole of the first developing roll, it has been confirmed that the effect of delivering the developer between the second developing roll and the first developing roll becomes extremely bad both in the case where the angle is not larger than 70° or in the case where the angle is not smaller than 120°, and, on the other hand, the effect of delivering the developer between the second developing roll and the first developing roll becomes best in the case where the angle is in the aforementioned range of from 90° to 100°.

As for the reaction pole induced between the developer-delivering magnetic pole and the developer-receiving magnetic pole of the first developing roll, it has been confirmed that the effect of delivering the developer between the second developing roll and the first developing roll becomes extremely bad in the case where the value of the magnetic flux density of the reaction pole is not smaller than 0.015 T, and, on the other hand, the effect of delivering the developer between the second developing roll and the first developing roll becomes best in the case where the value of the magnetic flux density of the reaction pole is 0.01 T.

On the other hand, because the position of the pole ($c_1$) which is a developer-delivering magnetic pole of the second developing roll is set so that a tangential line (k-q) which is drawn so as to touch the circumferential surface of the second developing roll at a point (k) corresponding to the delivering magnetic pole ($c_1$) of the second developing roll is located between a line (k-$o_2$) which is drawn from the point(k) on the circumferential surface of the second developing roll to the center ($o_2$) of the first developing roll and a tangential line (k-r) which is drawn from the point (k) on the circumferential surface of the second developing roll so as to touch the circumferential surface of the first developing roll at a point (r) on the developer-receiving and carrying side of the first developing roll. Accordingly, the angle between a tangential vector expressing-the throwing-out of the developer from the pole c($_1$) acting as a developer-delivering magnetic pole of the second developing roll and a tangential vector expressing the carrying of the developer at a point of intersection of the former tangential vector and the circumferential surface of the first developing roll is set so as to be not larger than 90° (that is, the two tangential vectors are not opposite to each other). Accordingly, there is no risk that the developer which is coming to the pole ($a_2$) acting as a developer-receiving magnetic pole of the first developing roll and the developer which is going out from the developer-receiving magnetic pole ($a_2$) of the first developing roll collide against each other so that the developer is jammed between the second developing roll and the first developing roll or make the developer overflow to another position to thereby cause unstable carrying of the developer.

Further, because the developer-receiving magnetic pole ($a_2$) of the first developing roll (1) is located behind, with respect to the direction of rotation of the first developing roll (1), the point (g) at which the tangential line (k-q), which is drawn from the point (k) on the circumferential surface of the second developing roll so as to touch the circumferential surface of the first developing roll at a point (f) on the developer-receiving and carrying side of the first developing roll, intersects the circumferential surface of the first developing roll (1), there is no risk that the pole ($a_2$) acting as a developer-receiving magnetic pole of the first developing roll (1) cannot catch the developer completely. Accordingly, the developer is prevented from escaping to a direction reverse to the direction of carrying the developer. As a result, the developer can be carried stably.

BRIEF DESCRIPTION OF THE DRAWING

The FIGURE is a longitudinal sectional view showing an embodiment of a developing device according to the present invention.

DESCRIPTION OF THE PREFERRED EMBODIMENT

The present invention will be described below on the basis of an embodiment shown in the drawing.

In the Figure, a developing device is equipped with a first developing roll 1, a second developing roll 4, a carrying roll for carrying a developer and a regulating plate 10, which are disposed in the inside of the developing device. The carrying roll 7 is constituted by a fixed magnet 9, and a sleeve 8 which is rotatable freely around the magnet 9.

The second developing roll 4 is constituted by a fixed magnet 6, and a sleeve 5 which is rotatable freely around the magnet 6.

The first developing roll 1 is composed of a fixed magnet 3, and a sleeve 2 which is rotatable around the magnet 3.

The magnet 9 has magnetic poles $a_0$, $b_0$, $c_0$, $d_0$ and $e_0$ on its surface. The magnet 6 has magnetic poles $a_1$, $b_1$, $c_1$, $d_1$, $e_1$ and $f_1$ on its surface. The magnet 3 has magnetic poles $a_2$, $b_2$, $c_2$, $d_2$, $e_2$, $f_2$ and $g_2$ on its surface. For example, the magnets are arranged so that when magnetic poles $a_0$, $c_0$, $e_0$, $b_1$, $e_1$, $a_2$, $c_2$, $e_2$ and $g_2$ are north poles (or south poles), the other magnetic poles $b_0$, $d_0$, $a_1$, $c_1$, $d_1$, $f_1$, $b_2$, $d_2$ and $f_2$ are south poles (or north poles). That is, the magnets are arranged so that the developer is carried while the polarities of the magnetic poles alternate between north pole (N pole) and south pole (S pole) in the order of N pole, S pole, N pole, S pole, . . .

The angle between the magnetic pole $c_1$ acting as a developer-delivering magnetic pole of the second developing roll 4 and the magnetic pole $d_1$ (see point m) acting as a developer-receiving magnetic pole of the second developing roll 4 is selected so as to be in a range of from 70° to 120°, preferably, from 90° to 100°. A reaction pole $z_1$ between the magnetic poles $c_1$ and $d_1$ (that is, a magnetic pole $z_1$ induced by the magnetic poles $c_1$ and $d_1$ and exhibiting a polarity reverse to the polarity of the magnetic poles $c_1$ and $d_1$) is selected so as to have a magnetic flux density not larger than 0.015 T, preferably, not larger than 0.01 T. The angle between the magnetic pole $a_2$ acting as a developer-receiving magnetic pole of the first developing roll 1 and the magnetic pole $g_2$ (see point t) acting as a developer-delivering magnetic pole of the first developing roll 1 is selected to be in a range of from 70° to 120° preferably, from 90° to 100°. A reaction pole $z_2$ between the magnetic poles $a_2$and $g_2$ is selected so as to have magnetic flux density not larger than 0.015 T, preferably, not larger than 0.01 T.

Further, the position of the developer-delivering magnetic pole $c_1$ of the second developing roll 4 is set so that a tangential line k-q which is drawn so as to touch the circumferential surface of the sleeve 5 at a point k corresponding to the developer-delivering magnetic pole $c_1$ of the second developing roll 4 is located between a line k-$o_2$ which is drawn from the point k to the center $o_2$ of the first developing roll 1 and a tangential line k-r which is drawn from the point k so as to touch the circumferential surface of the sleeve 2 at a point r corresponding to the developer-receiving and carrying side of the first developing roll 1.

Further, the developer-receiving magnetic pole $a_2$ of the first developing roll 1 is located behind (see point s, with respect to the direction of rotation of the sleeve 2 of the first developing roll 1, the point g at which the tangential line k-q intersects the circumferential surface of the first developing roll 1.

In the aforementioned configuration, the developer 12 is carried from the magnetic pole $a_0$ to the magnetic poles $b_0$, $c_0$, $d_0$and $e_0$ on the carrying roll 7 and then carried to the magnetic poles $a_1$, $b_1$ and $c_1$ of the second developing roll 4.

Here, the developer 12 thrown out from the magnetic pole $c_1$ is not involved in the magnetic pole $d_1$ side but it is delivered to the magnetic pole $a_2$ of the first developing roll 1. The developer 12 is carried to the magnetic poles $a_2$, $b_2$, $c_2$ and $d_2$ in order and further carried to the magnetic poles $e_2$, $f_2$ and $g_2$ while the thickness of the developer is regulated to a suitable value by the regulating plate 10.

Further, the developer 12 thrown out from the magnetic pole $g_2$ is carried to the magnetic poles $d_1$, $e_1$ and $f_1$ of the second developing roll 4, so that the developer falls down from the magnetic pole $f_1$.

According to the aforementioned configuration, in the case where the rotational speed of the developing rolls is increased to improve the printing speed, the magnetic field of the developer-receiving magnetic pole acting on the developer thrown out from the developer-delivering magnetic pole of the second developing roll is weak because the angle between the developer-delivering magnetic pole and the developer-receiving magnetic pole on the developing roll is set to be in a range of from 70° to 120°, preferably, from 90° to 100° (the reasons for the limitation of numerical values have been described above, and this applies to the following description) which is larger than the conventional value which is about 45°. Further, the magnetic field of the reaction pole acting on the developer thrown out from the developing roll is weak because the magnetic flux density of the reaction pole induced between the developer-delivering magnetic pole and the developer-receiving magnetic pole is set so as to be 0.015 T, preferably, 0.001 T, which is a small value. As a result, the developer thrown out from the developer-delivering magnetic pole is not involved in the developer-receiving magnetic pole side of the developing roll but it is carried to the developer-receiving magnetic pole of an adjacent developing roll stably.

Incidentally, the limitation of numerical values is based on experimental results as described preliminarily. As for the angle between the developer-delivering magnetic pole and the developer-receiving magnetic pole on the first developing roll, it has been confirmed that the effect of delivering the developer between the second developing roll and the first developing roll becomes extremely bad both in the case where the angle is not larger than 70° and in the case where the angle is not smaller than 120°, and that, on the other hand, the effect of receiving the developer between the second developing roll and the first developing roll becomes best in the case where the angle is in the aforementioned range of from 90° to 100°.

As for the reaction pole induced between the developer-delivering magnetic pole and the developer-receiving magnetic pole on the first developing roll, it has been confirmed that the effect of delivering the developer between the second developing roll and the first developing roll becomes extremely bad in the case where the value of the magnetic flux density of the reaction pole is not smaller than 0.015 T, and on the other hand, that the effect of receiving the developer between the second developing roll and the first developing roll becomes best in the case where the value of the magnetic flux density of the reaction pole is 0.01 T.

On the other hand, the position of the pole $c_1$ which is a developer-delivering magnetic pole of the second developing roll is set so that a tangential line k-q which is drawn so as to touch the circumferential surface of the second developing roll at a point k corresponding to the pole $c_1$ is located between a line k-$o_2$ which is drawn from the point k to the center $o_2$ of the first developing roll and a tangential line k-r which is drawn from the point k so as to touch the circumferential surface of the first developing roll at a point r on the developer-receiving and carrying side of said first developing roll. Accordingly, the angle between a tangential vector expressing the throwing-out of the developer from the pole $c_1$ acting as a developer-delivering magnetic pole of the second developing roll and a tangential vector expressing the carrying of the developer at a point of intersection of the former tangential vector and the circumferential surface of the first developing roll is set so as to be not larger than 90° (that is, the two tangential vectors are not opposite to each other). Accordingly, there is no risk that the developer which is coming to the pole $a_2$ acting as a developer-receiving magnetic pole of the first developing roll and the developer which is going out from the pole $a_2$ collide against each other to thereby jam the developer between the second developing roll and the first developing roll or make the developer overflow to another position to thereby cause unstable carrying of the developer.

Further, the pole $a_2$ of the first developing roll is located behind, with respect to the direction of rotation of the first developing roll, the point g at which the tangential line k-q intersects the circumferential surface of the first developing roll. Accordingly, there is no risk that the pole $a_2$ acting as a developer-receiving magnetic pole of the first developing roll 1 cannot catch the developer completely. Accordingly, the developer is prevented from escaping to a direction reverse to the direction of the carrying of the developer. As a result, the developer can be carried stably.

According to the present invention, even in the case where the rotational speed of the developing rolls is increased to improve the printing speed, that is, even in the case where the developer is thrown out by a centrifugal force produced by the rotation of the developing rolls, stable delivery of the developer between one and the other developing rolls is performed so that not only the developer is prevented from jamming between adjacent two developing rolls and further between a developing roll and a photosensitive body 11 to thereby obtain stable printing quality but also it is possible to solve the problem that the rotation of the photosensitive body or the developing roll is made difficult to cause the printing impossible.

What is claimed is:

1. A developing device in an electrophotographic apparatus which includes a photosensitive member, comprising:

first and second developing rolls which rotate in the same direction, each of said first and second developing rolls including a fixed magnet having a plurality of magnetic poles, and a sleeve which is rotatable around said magnet;

a regulating plate arranged at a predetermined distance from the circumferential surface of said first developing roll, for regulating a developer;

wherein the developer is carried by a circumferential surface of said second developing roll not facing the photosensitive member so as to be delivered to a circumferential surface of said first developing roll not facing the photosensitive member, and regulated to a predetermined amount by said regulating plate, whereafter the photosensitive member is subjected to development of a first time while the developer is carried by the circumferential surface of said first developing roll facing the photosensitive member, and the photosensitive member is subjected to development of a second time while the developer is carried by the circumferential surface of said second developing roll facing the photosensitive member;

wherein said second developing roll has a delivering magnetic pole $c_1$ for delivering the developer to said first developing roll, whereas said first developing roll has a receiving magnetic pole $a_2$ for receiving the developer from said second developing roll;

wherein the position of the pole $c_1$ is set so that a tangential line k-q which is drawn so as to touch the circumferential surface of said second developing roll at a point k corresponding to the pole $c_1$ is located between a line k-$o_2$ which is drawn from the point k to the center $o_2$ of said first developing roll and a tangential line k-r which is drawn from the point k so as to touch the circumferential surface of said first developing roll at a point r on the developer-receiving and carrying side of said first developing roll.

2. A developing device as claimed in claim 1, wherein the pole $a_2$ of said first developing roll is located behind, with respect to the direction of rotation of said first developing roll, the point q at which the tangential line k-q intersects the circumferential surface of said first developing roll.

* * * * *